US005848475A

United States Patent [19]

Hill et al.

[11] Patent Number: 5,848,475

[45] Date of Patent: Dec. 15, 1998

[54] RAZOR AND BLADE

[76] Inventors: James L. Hill, 101 W. 147th St., Apt. 25C, New York, N.Y. 10039; Arthur L. Symes, 300 Albany St., Apt. 7I, New York, N.Y. 10280

[21] Appl. No.: 839,260

[22] Filed: Apr. 17, 1997

[51] Int. Cl.[6] ..... B26B 21/16; A45D 27/24

[52] U.S. Cl. ..... 030/527; 030/40.2; 030/51; 030/57; 030/75; 030/330; 030/346.61

[58] Field of Search ..... 30/30, 31, 40, 30/40.1, 40.2, 51, 53, 75, 527, 528, 330, 331, 337, 339, 346.6, 346.61, 57, 47

[56] References Cited

U.S. PATENT DOCUMENTS

| | | | |
|---|---|---|---|
| 328,202 | 10/1885 | Dyer | 30/527 |
| 777,667 | 12/1904 | Fleming | 30/331 |
| 1,411,552 | 4/1922 | Aitken | 30/527 |
| 1,479,690 | 1/1924 | Angst | 30/527 |
| 1,500,165 | 7/1924 | Thorpe | 30/527 |
| 1,796,260 | 3/1931 | Gaisman | 30/57 |
| 1,901,830 | 3/1933 | Gaisman | 30/40.2 |
| 1,943,414 | 1/1934 | Behrman | 30/75 |
| 2,050,395 | 8/1936 | Testi | 30/75 |
| 2,060,445 | 11/1936 | Ryley | 30/527 |
| 2,062,683 | 12/1936 | Smith | 30/57 |
| 2,086,648 | 7/1937 | Strauss | 30/57 |
| 2,161,403 | 6/1939 | Ashworth | 30/75 |
| 3,054,181 | 9/1962 | Kitashiro | 30/346.61 |
| 3,154,852 | 11/1964 | Westlake, Jr. | 30/51 |
| 3,861,034 | 1/1975 | Cerino | 30/75 |
| 5,012,578 | 5/1991 | Siefer | 30/47 |

*Primary Examiner*—Hwei-Siu Payer
*Attorney, Agent, or Firm*—Hopgood, Calimafde, Kalil & Judlowe

[57] ABSTRACT

The invention provides a razor having a retaining mechanism adapted to receive a blade longer than the mechanism for retaining the blade so that one or both wings of the blade extend past the retaining mechanism to provide a small straight razor. Additionally, the blade is positionable within the retaining mechanism so that its wing can be extended from one or the other side of the retaining mechanism. The retaining mechanism for the blade has a pivotably-attached handle to allow ergonomic adjustment of the shaving angle. The blade and retaining mechanism have associated mechanisms for retaining and aligning the blade in the retaining mechanism.

12 Claims, 5 Drawing Sheets

FIG. 3
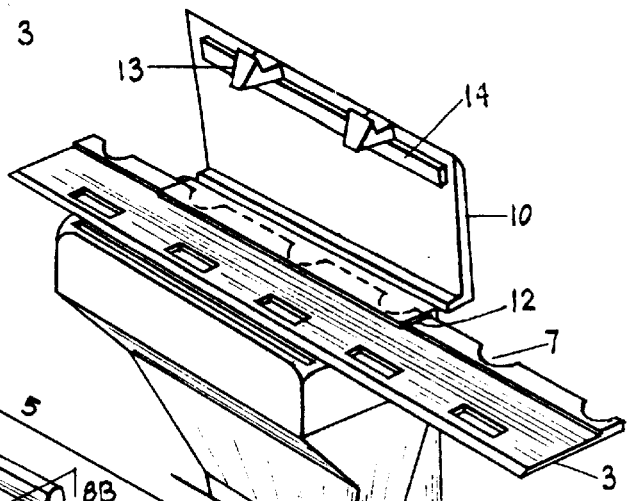
FIG. 1
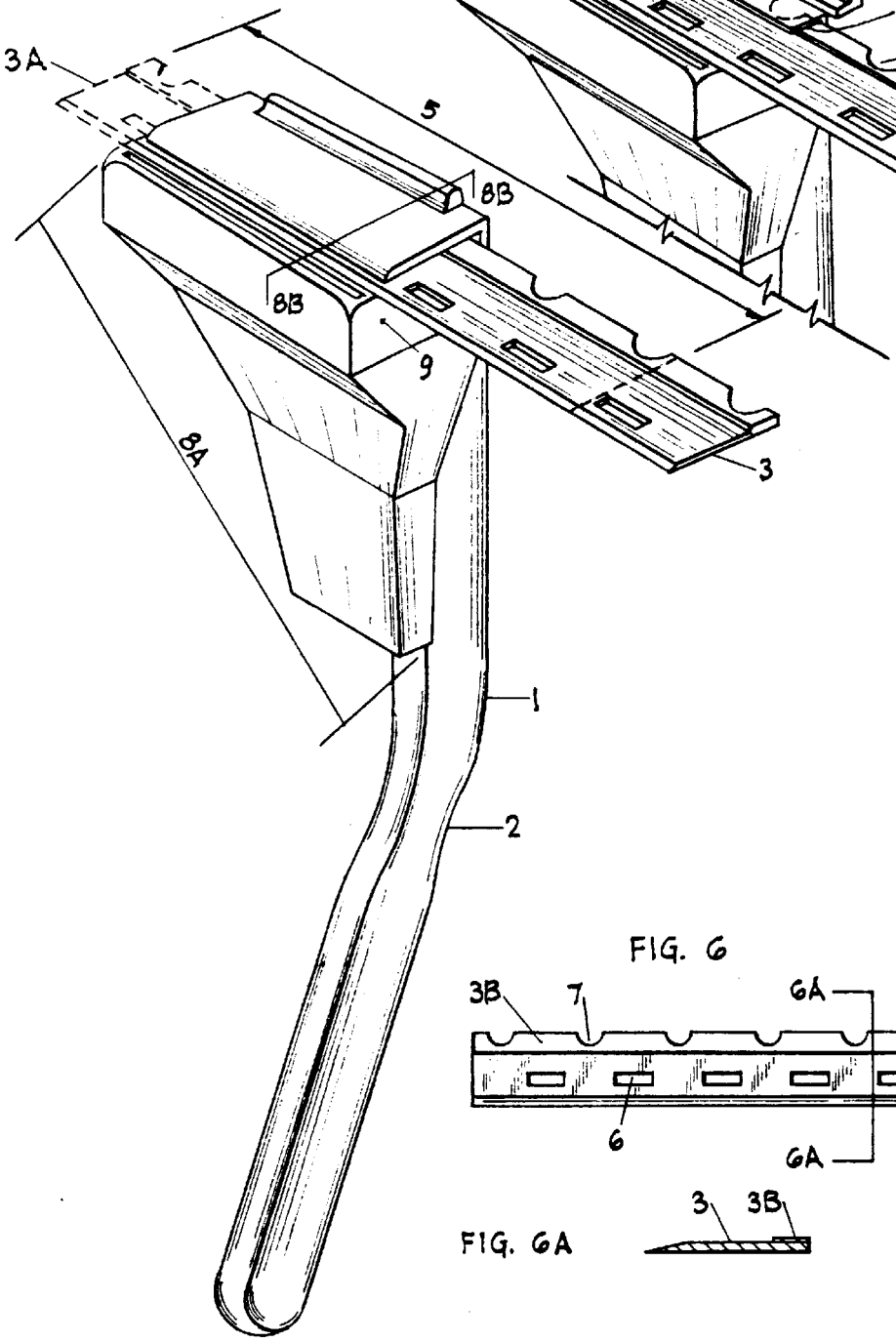
FIG. 6
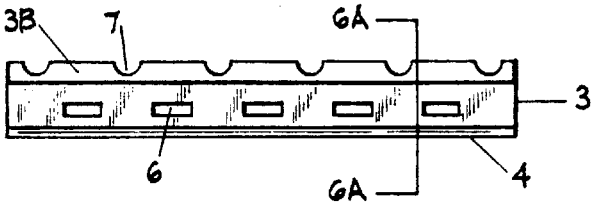
FIG. 6A 16
17A
1A
22
22A
28
11
12
3B
10
3
14
17
18
19
13
20
21
4
27
22A
28
9

RAZOR AND BLADE

BACKGROUND OF THE INVENTION

This invention relates to a razor and to an associated blade adjustable therein.

The state of the art in manual razors (as opposed to electric razors) has not changed significantly since the introduction of the safety razor. One of the drawbacks of shaving with a straight razor is that it is unwieldy because it is designed like a knife, with the handle at one end of the blade; a straight razor is essentially a blade hinged to a sheath or case.

As opposed to a straight razor, a safety razor has a guard to prevent deep cuts in the skin. Whether of a more permanent or of a disposable type, the guard provided on a safety razor has, as one drawback, that various areas of the face are difficult to shave; a particularly troublesome area is that above the upper lip. Another drawback of the safety razor is difficulty in shaving around hair, such as with moustaches and goatees, and with sideburns.

SUMMARY AND OBJECTS OF THE INVENTION

In view of the foregoing, the present invention provides a razor useful for shaving that also facilitates shaving around hair, that is easier to handle and manipulate than a straight razor, and yet which also has attributes of a straight razor that recall an earlier time in the habit of shaving.

The razor is preferably of a permanent (as opposed to disposable) construction so the user is presented with an assembled mechanism capable of shaving/styling facial hair.

The present invention provides a razor adapted to receive a blade that extends, along the plane of the cutting edge of the blade, beyond the portion of the razor that holds the blade. This invention provides, more particularly, a razor comprising a handle pivotably joined to a retaining mechanism, the retaining mechanism adapted to receive and releasably retain a blade in a manner suitable for shaving, and the retaining mechanism having a predetermined extent less than that of the blade. This invention also provides a blade that is positionable in the retaining mechanism so that the blade extends from the left, right or from both sides of the blade holder. To further facilitate shaving, the handle is ergonomically designed to extend out of the plane of the razor towards the cutting edge of the blade.

BRIEF DESCRIPTION OF THE DRAWINGS

FIG. 1: PERSPECTIVE OVERVIEW of an embodiment of the razor of this invention with a blade.

FIG. 3: PERSPECTIVE VIEW WITH BLADE LOCKING MECHANISM COVER OPEN shows its associated parts and blade seated in retaining mechanism.

FIG. 6: BLADE TOP VIEW showing configuration.

FIG. 6A: BLADE CROSS SECTION with its cutline taken at 3A.

Figure 8:
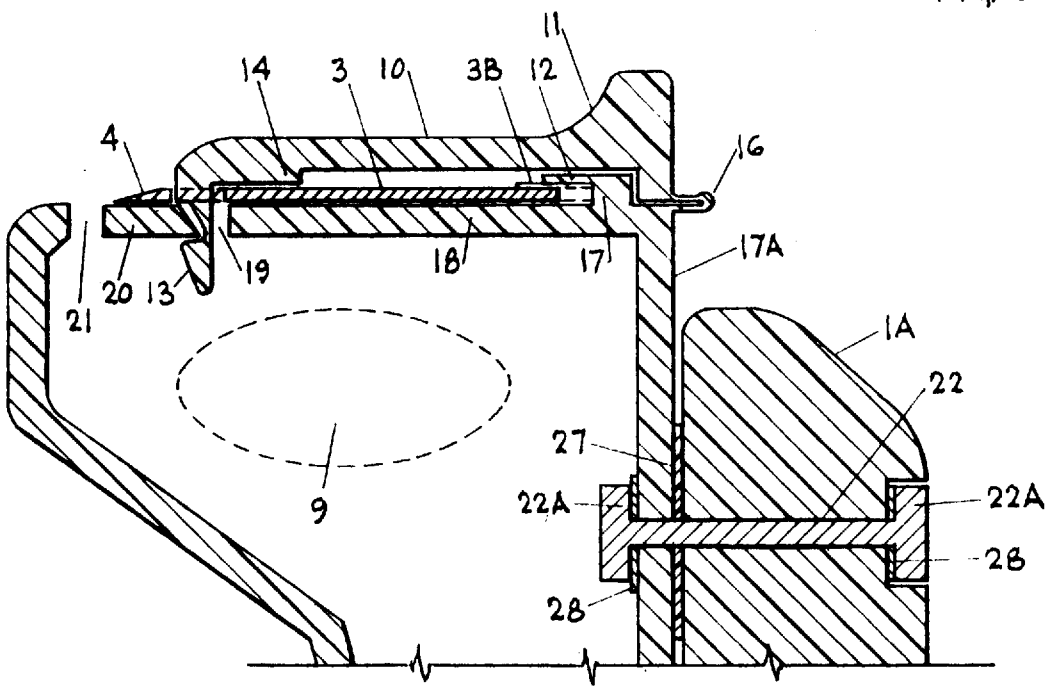
FIG. 8: RETAINING MECHANISM CROSS SECTION at cutline 8B in FIG. 1 with BLADE LOCKING MECHANISM COVER down securing BLADE and its association to the handle.
Figure 9:
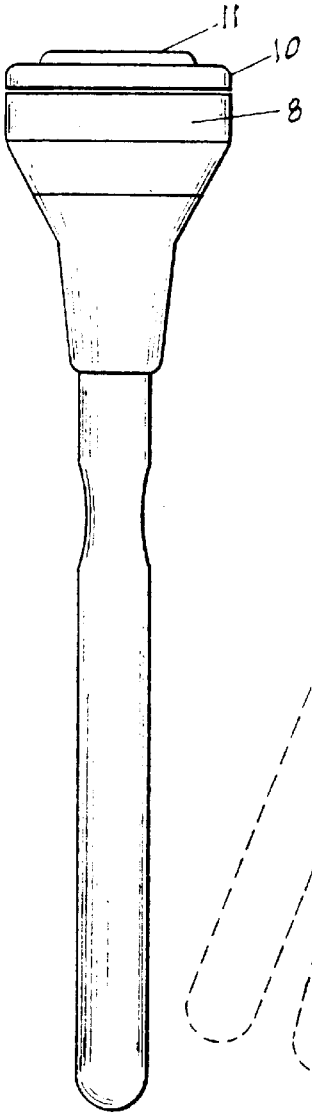
FIG. 9: FRONT VIEW of an embodiment of the razor of this invention.

In the following descriptions, parenthetical references are made to figures and the reference numerals therein, for example, element 17 in FIG. 8 is referenced as (FIG. 8-17).

DETAILED DESCRIPTION OF SPECIFIC EMBODIMENTS

FIG. 1 is a perspective view of the front (i.e., the side facing the skin or hair being shaved) of one embodiment of the razor which includes a handle (1) and preferably having a grip (2) facilitating means, such as one or more finger recesses, optionally/preferably with stippled grooves and a retaining mechanism (FIG. 2-8) for holding a blade. The blade (3) is shown engaged in the retaining mechanism with one end (3A) extending past the edge/end of the positioning seat (FIG. 5-18). The blade can be seated in an alternative position (5) or with ends extending from both edges of the positioning seat. The length of the retaining mechanism (8A) shows its relative dimension to the handle. The cutline cross section (8B) provides a detailed examination of the retaining mechanism. The side squeeze depression (9) facilitates the unlocking mechanics of locking mechanism cover (FIG. 2-10).

Figure 2:
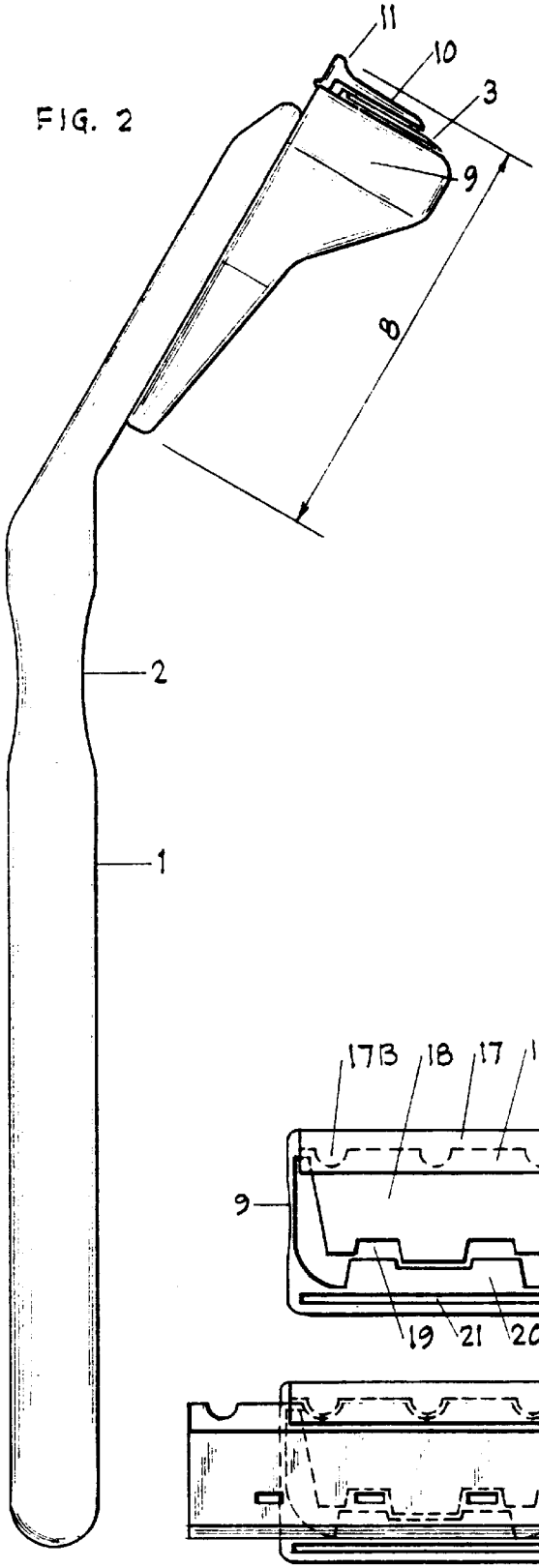
FIG. 2: SIDE VIEW of an embodiment of the razor with a blade.

FIG. 2 is a side view of the invention.

The handle (1) is preferably provided with a bend and stippled handle finger grip (2) slightly concave to aid in its alternative positioning and ergonomics. The blade (3) is detailed in FIGS. 6 and 6A; the retaining mechanism (8) is detailed in FIG. 8, the function of the side squeeze depression (9) noted in FIG. 1 is detailed in the FIG. 8 narrative. The locking mechanism cover (10) and cover finger grip (11) functions are detailed in FIG. 8.

FIG. 3 is a Perspective View with Blade Locking Mechanism Cover Open.

Figure 4:
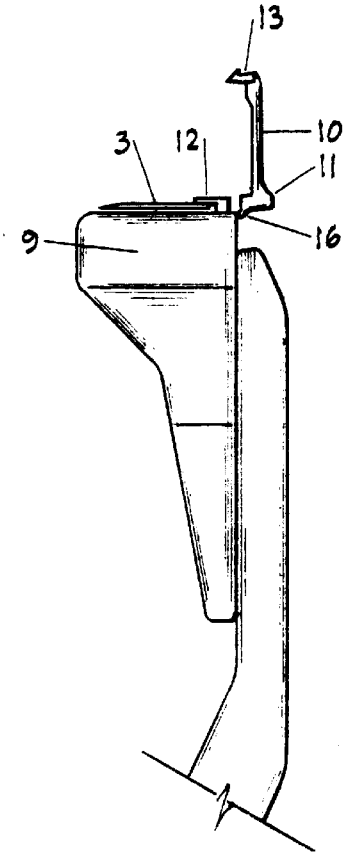
FIG. 4: SIDE VIEW WITH LOCKING MECHANISM COVER OPEN showing an embodiment of the razor with the cover open.

The blade top plan view (3) is detailed in FIG. 6, the positioning recesses (7) of the blade are designed to aid in preventing the movement of the blade through registry with the blade abutment posts (FIG. 5-17B). The locking mechanism cover (10), when folded down, secures registration of the blade to the retaining mechanism. The hold down strip (12), blade bias strip (FIG. 6-3B) and pressure bar (14) act to prevent blade rotation from pressure exerted on the blade's cutting edge (FIG. 6-4). The cover locking clips (13) passes through the locking slots in the blade (FIG. 6-6) and register and secure placement to the locking clip release (FIG. 8-20). The cover locking clips (13) secure and position the blade against the blade abutment (FIG. 5-17) and the blade abutment posts (FIG. 5-17). The pressure bar (14) portion of the cover forcibly biases the blade to the positioning seat (FIG. 5-18). To further aid in preventing movement of the blade along the abutment wall, an optional facing layer on both sides of the blade bias strip (FIG. 6-3B), such as a plasticized polymer, rubber, or similar material may be used to provide friction against the blade sliding along the positioning seat.

FIG. 4 is a side view with Locking Mechanism Cover Open.

The blade bias strip (FIG. 6-3B) is disposed on the rear part of the blade as a separate component fused thereto (or otherwise integral therewith) and is positioned under the hold down strip (12). To open the locking mechanism cover (10), the side squeeze depressions (9) are pressed inward toward each other, popping up the locking mechanism cover (10) for rotation about the hinge (16) connection by pressure on the cover finger grip The cover locking clip (13) function is detailed in FIG. 8 narrative.

Figure 5:
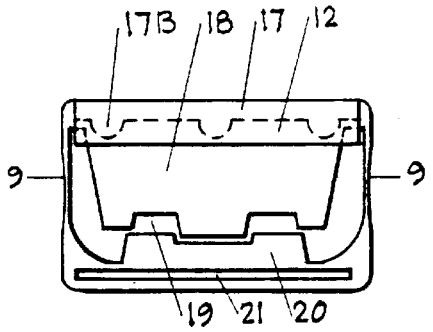
FIG. 5: TOP VIEW RETAINING MECHANISM WITHOUT COVER shows configuration with associated parts.

FIG. 5 is a Top View of the Retaining Mechanism Without Cover.

The side squeeze depressions (9) preferably have a concave construction. The hold down strip (12) is hidden when the locking mechanism cover (FIG. 4-10) is registered to the retaining mechanism (FIG. 2-8). The locking clip release (20) and clip release opening/cavity (21) are detailed in FIG. 8. The blade abutment (17) is configured with blade abutment posts (17) to cooperatively engage the blade's positioning recesses (FIG. 6-7) to both align the blade and inhibit blade movement. In front of the positioning seat (18) are the cover locking slots (19).

FIG. 6 is a Top View of the Blade.

The blade in this embodiment has a cutline (6A) showing its cross section in FIG. 6A. Proximal to the cutting edge (4) are a plurality of locking slots (6) permitting the cover locking clips (FIG. 3-13) to pass through the cover locking slots (FIG. 5-19) to an associated locking clip release (FIG. 8-20).

FIG. 6A Blade Cross Section.

The blade bias strip (3B) frictionally secures the blade under the hold down strip (FIG. 3-12).

Figure 7:
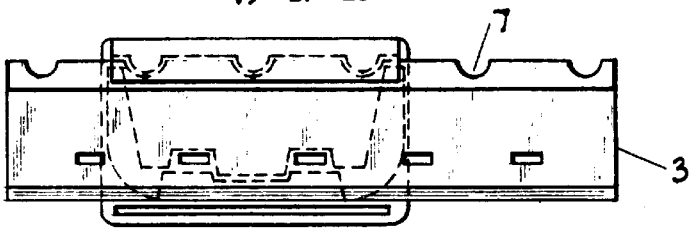
FIG. 7: TOP VIEW RETAINING MECHANISM WITH BLADE WITHOUT COVER configured seating.

FIG. 7 Top View Retaining Mechanism with BLADE WITHOUT COVER.

The positioning recesses (7) of the blade (3) cooperatively interface with the blade abutment posts (FIG. 5-17).

FIG. 8 Retaining Mechanism Cross Section.

The retaining mechanism cross section taken along cutline FIG. 1-8B is an embodiment exhibiting its connection to the top end of the invention's pivotably attached handle (1A). In this embodiment the locking mechanism cover (10) is closed with a blade (3) forcibly biased by a pressure bar (14) to a positioning seat (18). The blade bias strips (3B) is positioned under a hold down strip (12) adjacent to the blade abutment (17). The flexible locking mechanism cover (10), with a unified hinge (16) facilitates the forward and backward rotation of the cover locking clips (13) and their passage through both the blade's locking slots (FIG. 6-6) and cover locking slots (19) to engagement with the cover locking clip release (20) registering the blade (3) to the retaining mechanism (FIG. 2-8).

To open the locking mechanism cover (10), the side squeeze depressions (9) are pressed inward, causing the locking clip release (20) to move into the clip release opening/cavity (21) area and disengage the cover locking clips (13). Applying modest leverage to the cover finger grip (11), locking mechanism cover (10) can be rotated on its hinge (16) by withdrawal of the cover locking clips (13) through the cover locking slots (19) and the blade's locking slots (FIG. 6-6) which are proximal to the blade's cutting edge (4). The retaining mechanism (FIG. 2-8) and handle (1A) conjoin at the rear retaining wall (17A). Transversing the rear retaining wall (17A) and handle (1A) is a swivel connecting pin (22), secured at each end by swivel pin heads (22A). A washer (27) (preferably plastic, e.g., neoprene) separates the handle from the rear retaining wall (17A) and washers (28) (e.g., steel) separate the swivel pin heads (22A) from the retaining mechanism (FIG. 2-8) and handle (1A).

FIG. 9 Front View.

This front view of the invention with the handle (1) in this embodiment in its standard position, exhibiting its ergonomically designed handle finger grip (2). The retaining mechanism (8) is shown with its locking mechanism cover (10) closed and cover finger grip (11).

Figure 10:
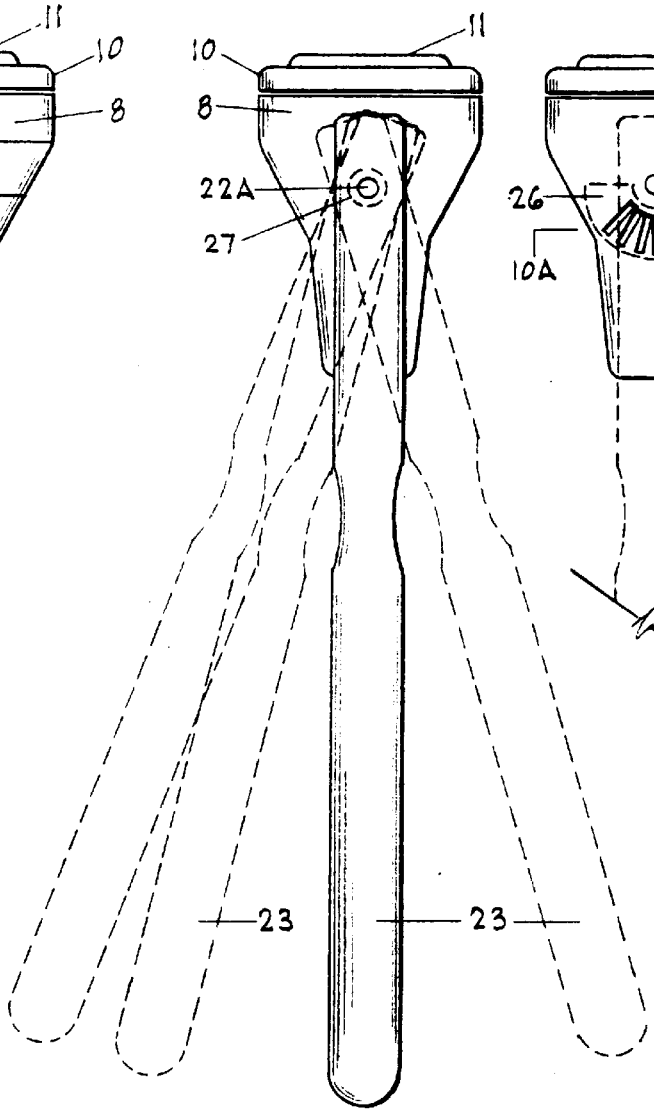
FIG. 10: BACK VIEW SHOWING ALTERNATIVE POSITIONING of handle.

FIG. 10 Back View Showing Alternative Positioning.

This back view depicts alternative positions (23) of the handle with a closed locking mechanism cover (10) and the cover finger grip (11). One of the swivel pin heads (22A) that conjoin the handle (1) to the retaining mechanism (8) is seen and the washer (27) therebetween is also shown.

Figure 11:
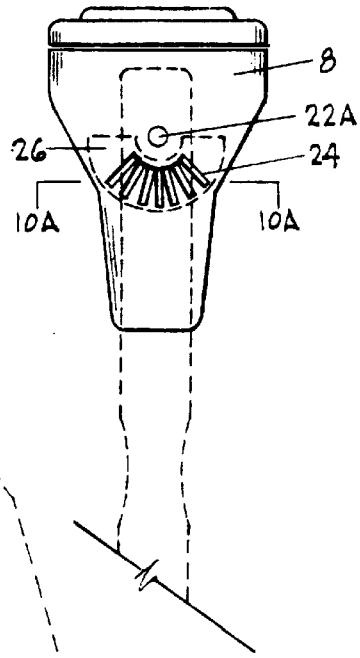
FIG. 11: BACK VIEW SHOWING SEATING GROOVES in RETAINING MECHANISM.

FIG. 11 Back View Showing Seating Grooves.

The back view shows magnet seating grooves (24) situated in the retaining mechanism (8). The swivel pin head (22A) is situated in the retaining mechanism. The retaining mechanism magnet (26) attracts the seating of the imbedded handle magnet (25) to the magnet seating grooves (24).

Figure 12:
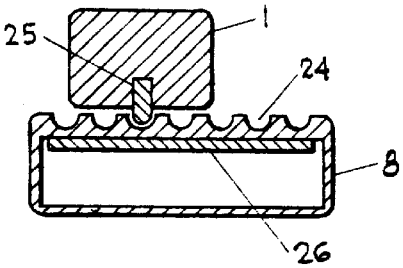
FIG. 12: HANDLE POSITIONING MECHANISM CROSS SECTION at cutline 10A in FIG. 11 showing interface of handle to RETAINING MECHANISM.

FIG. 12 Handle Positioning Mechanism Cross Section.

The handle (1) alternative positioning is facilitated by the insertion of its imbedded handle magnet (25) into any one of the retaining mechanism's plural magnet seating grooves (24) (preferably seven in number). The handle is magnetically secured by the retaining mechanism magnet (26) that is disposed inside the retaining mechanism (8).

Figure 13:
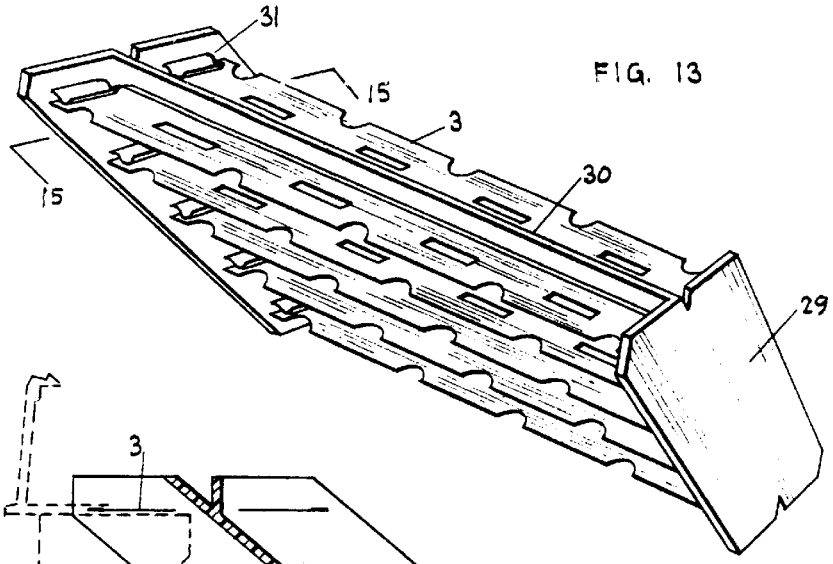
FIG. 13: BLADE DISPENSER PERSPECTIVE OVERVIEW showing embodiment of this invention.

FIG. 13 Blade Dispenser Perspective Overview.

The blade dispenser (FIG. 13) is depicted for such blades as described herein. In operation, the user would open the locking mechanism cover to allow for insertion of a new blade. The blades (3) are retained within the end walls (29) of the dispenser and releasably transferrable from the dispenser to a seating position (FIG. 5-18) on the razor after an alignment with the adjacent blade abutment (FIG. 5-17) and configured to the selected blade abutment posts (FIG. 5-17B). A blade dispenser separator (30) supports the structure and facilitates blade capacity enhancement as shown in this embodiment. A cutline cross section (15) of the blade dispenser is seen in FIG. 15.

Figure 14:
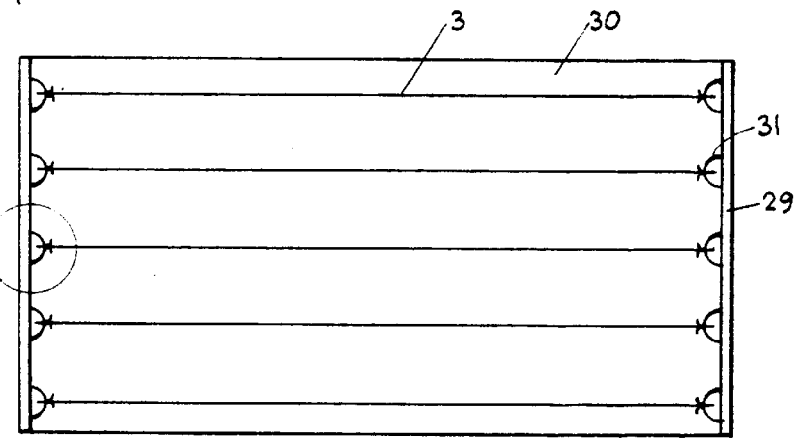
FIG. 14: BLADE DISPENSER FRONT VIEW showing associated parts of this invention.

FIG. 14 Blade Dispenser Front View.

The blade dispenser front view depicts a series of blades retained within the end walls (29) of the blade dispenser. In this embodiment a corresponding number of blades are retained but partitioned by the dispenser separator (30). The blades are preferably releasably retained in the dispenser by a number of blade grips (31), shown in detail in FIG. 16.

Figure 15:
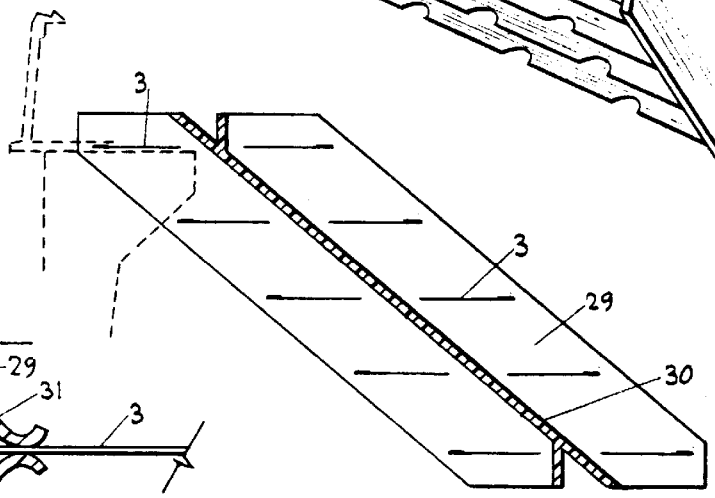
FIG. 15: BLADE DISPENSER CROSS SECTION at cutline 15 in FIG. 13 showing registry with razor.

FIG. 15 Blade Dispenser Cross Section.

The blade dispenser cross section (FIG. 15) shows a series of blades (3) within the end walls (29) positioned for transfer to a razor with additional blades partitioned by the dispenser's separator (30).

Figure 16:
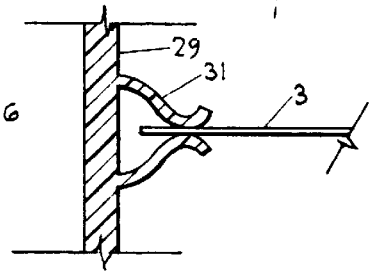
FIG. 16: DETAIL OF BLADE GRIP showing associated parts of this invention.

FIG. 16 Detail of Blade Grip.

The blades (3) positioned in the dispenser are retained by the blade grips' leaf springs (31) that extend from the end walls (29) and are force fitted onto the edge of the blade. In operation, the blade (3) is released from the blade dispenser's (FIG. 13) blade grip (31) after the blade is registered in the retaining mechanism (8) and the locking mechanism cover is closed/locked and the razor is then pulled away from the blade dispenser.

In various commercial embodiments, the novel razor and blade of this invention can be provided together as a kit (combination razor and blades), optionally with a carrying case or holder adapted to retain both the razor and blades or blade case as shown in any of FIGS. 13–16. Still further, the instant razor, preferably also with the instant blades, can be provided in combination as a kit that further includes a container of shaving cream (e.g., an aerosol-dispensable shaving composition) or a cup or container and a brush or beater with which a lathered shaving composition can be produced.

The present invention has been described with reference to the foregoing embodiments and examples without being limited by the particular content thereof, and various additions, substitutions, deletions and other modifications thereof intended to be within the scope and spirit of the invention as defined by the following claims.

What is claimed:

1. A razor, comprising: a handle joined to a retaining mechanism about a pivot axis, the retaining mechanism adapted to receive and releasably retain a blade in a manner suitable for shaving/styling facial hair, and the pivot axis essentially parallel with the width of a blade in the retaining mechanism, said blade having a cutting edge, said blade having a predetermined extent greater than that of said retaining mechanism, whereby at least one portion of the cutting edge extending beyond the extent of the retaining mechanism is used for shaving/styling facial hair.

2. The razor of claim 1, further comprising means for registering the blade in a retained position along at least two positions of the extent of the retaining mechanism.

3. The razor of claim 1, wherein the retaining mechanism comprises an abutment wall and locking mechanism cover adapted for retaining the blade.

4. The razor of claim 3, further comprising means for biasing the blade against the abutment wall.

5. The razor of claim 1, further comprising means for discretely positioning the pivotable handle.

6. The razor of claim 1, wherein the handle is bent.

7. The razor of claim 1, wherein the handle comprises means for facilitating gripping.

8. A plurality of blades in combination with a dispenser therefor, each of said blades comprising a generally rectangular body with four edges, said rectangular body defining a longitudinal extent, one of said four edges comprising along its length a cutting edge parallel with the longitudinal extent, a first plurality of registrations disposed in said body generally parallel with the longitudinal extent, and, in an abutment edge opposite from the cutting edge, a second plurality of registrations formed in said abutment edge, and said dispenser comprising a pair of opposing parallel end walls, a separator support wall orthogonal to and connecting said end walls, each of said end walls having a plurality of spaced-apart blade grips, a pair of such grips disposed on opposing end walls being adapted for releasably securing each of said blades such that the extent of each such blade is generally parallel to the support wall and orthogonal to said end walls, and each of said blades being offset, along the plane of said end walls, from each blade adjacent thereto.

9. The combination of claim 8, wherein said dispenser comprises said plurality of blades disposed on both sides of said separator wall.

10. The combination of claim 8, wherein said blades are arranged step-wise.

11. The plurality of blades in combination with the dispenser as defined by claim 8, wherein each of said blades further comprises along its abutment edge a blade bias strip.

12. The plurality of blades in combination with the dispenser as defined by claim 8, wherein both said first plurality of registrations and said second plurality of registrations each comprises three registrations.

* * * * *